US005543907A

United States Patent [19]

Kato et al.

[11] Patent Number: 5,543,907

[45] Date of Patent: Aug. 6, 1996

[54] COPYING APPARATUS WHICH CAN PROHIBIT THE SORTING PROCESS

[75] Inventors: Tomokazu Kato, Toyokawa; Kazuhiro Araki; Yoshiaki Takano, both of Toyohashi; Syuzi Maruta, Toyokawa; Keiichi Nomura, Amagasaki; Kentaro Nagatani, Toyohashi; Takashi Noda; Hiroyuki Kishimoto, both of Toyokawa, all of Japan

[73] Assignee: Minolta Camera Kabushiki Kaisha, Osaka, Japan

[21] Appl. No.: 945,261

[22] Filed: Sep. 15, 1992

[30] Foreign Application Priority Data

Sep. 18, 1991 [JP] Japan ..... 3-237641

[51] Int. Cl.[6] ..... G03G 21/00

[52] U.S. Cl. ..... 355/313; 271/288; 271/292; 355/323

[58] Field of Search ..... 355/208, 308, 355/313, 314, 316, 323; 271/278, 279, 287, 288, 292, 298

[56] References Cited

U.S. PATENT DOCUMENTS 4,338,023 6/1982 McGibbon ..... 355/206
4,684,241 8/1987 Acquavia ..... 355/323
4,757,356 7/1988 Garofalo ..... 271/298 X
4,974,034 11/1990 Rabb et al. ..... 355/319

FOREIGN PATENT DOCUMENTS 61-123861 6/1986 Japan .
62-55665 11/1987 Japan .

*Primary Examiner*—Leo P. Picard
*Assistant Examiner*—Christopher Horgan
*Attorney, Agent, or Firm*—Burns, Doane, Swecker & Mathis, L.L.P.

[57] ABSTRACT

A control circuit changes a sorting mode of a sorter corresponding to a state whether an original is both-sided or not, or whether or not a plurality of originals are simultaneously reproduced in one round of copying process when images of a plurality of originals are distributively reproduced on the same side of a transfer sheet, or whether a mode of the number of sheets of original and copy mode are for both sides mode or composite mode. With such a control, a sorting mode process is prohibited when a required transfer sheet is one irrespective of whether the number of sheets of original is one or not.

32 Claims, 15 Drawing Sheets

COPYING APPARATUS WHICH CAN PROHIBIT THE SORTING PROCESS

BACKGROUND OF THE INVENTION

Technical Field of the Invention

The present invention relates to a copying apparatus for producing copies of originals, and more particularly, to a copying apparatus which is provided with an automatic sheet feed means for feeding originals one by one for a copying process and a sheet discharge means for selectively discharging transfer sheets in a sorted state and a non-sorted stated after a copying process has been completed.

Brief Description of Related Art

When a copying process is performed for a plurality of copy sheets with a plurality of originals, it is desired to have transfer sheets discharged in the sequence of page number. In order to satisfy the requirement, a copying machine which is provided with a sorter has heretofore been introduced wherein the sorter is capable of sorting transfer sheets into each of a plurality of bins by properly discharging the transfer sheets after a copying process has been completed. A sorter to be used with a copying machine is also introduced as an optional device.

In the sorter, when a copying operation is performed for a plurality of sheets, a sorting mode process is adopted for discharging transfer sheets in a sorted state wherein the transfer sheets are sorted in each of a plurality of bins in the sequence of page number.

On the other hand, when there is only one original, it is not necessary to sort copy sheets in the sequence of page number even if a copying process is performed for a plurality of sheets. If a plurality of sheets are processed under a sorting mode in this case, a plurality of reproduced transfer sheets are discharged into each of different bins which requires wasteful labor to take them out individually. In order to solve such a problem, even if a copying machine is capable of performing a sorting mode process, the copying machine is arranged to select a non-sorting mode process. However, it sometimes happens that the sorting mode is erroneously selected even when there is only one original, or an operator conducts a copying operation for a plurality of sheets from one original without knowing that an operator who previously used the machine selected a sorting mode and forgot to release the mode. Such an inconvenience tends to happen easily in a kind of machine wherein a sorting mode process is preferentially performed.

In Japanese Published Unexamined Patent Application No. 61-123861, there is disclosed a copying apparatus for solving the above-mentioned problems. In the apparatus, it is arranged that a sorting mode is automatically prohibited when there is only one original so as to perform a copying process under a non-sorting mode.

In recent years, there is introduced a copying apparatus which is arranged to subsequently perform a copying process corresponding to a single sided original or both sided original wherein several original mode processes can be selected.

There is also introduced a copying apparatus which is capable of selecting various copy modes according to a requirement of single side copy mode process for reproducing an image of single sided original or both-sided original on one side of a copy sheet, or a both sides copy mode process for reproducing an image on both sides of a copy sheet, or a composite copy mode process for copying and composing two images on the same side of a transfer sheet, or an original handling mode process for distributively reproducing two images on the same side of a transfer sheet (hereinafter called as two-in-one copy mode process).

In such cases, however, it is not sufficient to only prohibit a sorting mode when there is one original. For instance, even when there are two sheets of single sided originals, transfer sheet to be discharged after a copying process is one if a mode is set for both sides copy mode, composite copy mode or two-in-one copy mode. Likewise, even when there are four sheets of single sided originals, transfer sheet to be discharged after a copying process is one if two of the both sides copy mode, composite copy mode and two-in-one copy mode are synchronously selected. Accordingly, the sorting mode process is not required in any one of these cases.

SUMMARY OF THE INVENTION

A primary object of the present invention is to provide a copying apparatus which is capable of solving inconveniences which arise from a process of equally prohibiting or allowing a sorting mode depending on whether original is one or not.

Another object of the present invention is to provide a copying apparatus which is capable of solving an inconvenience wherein a mode set during a copying process is freely changed by equally prohibiting a sorting mode when a copying process is resumed after jam trouble is cleared.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will be described hereinafter referring to accompanying drawings.

Figure 1:
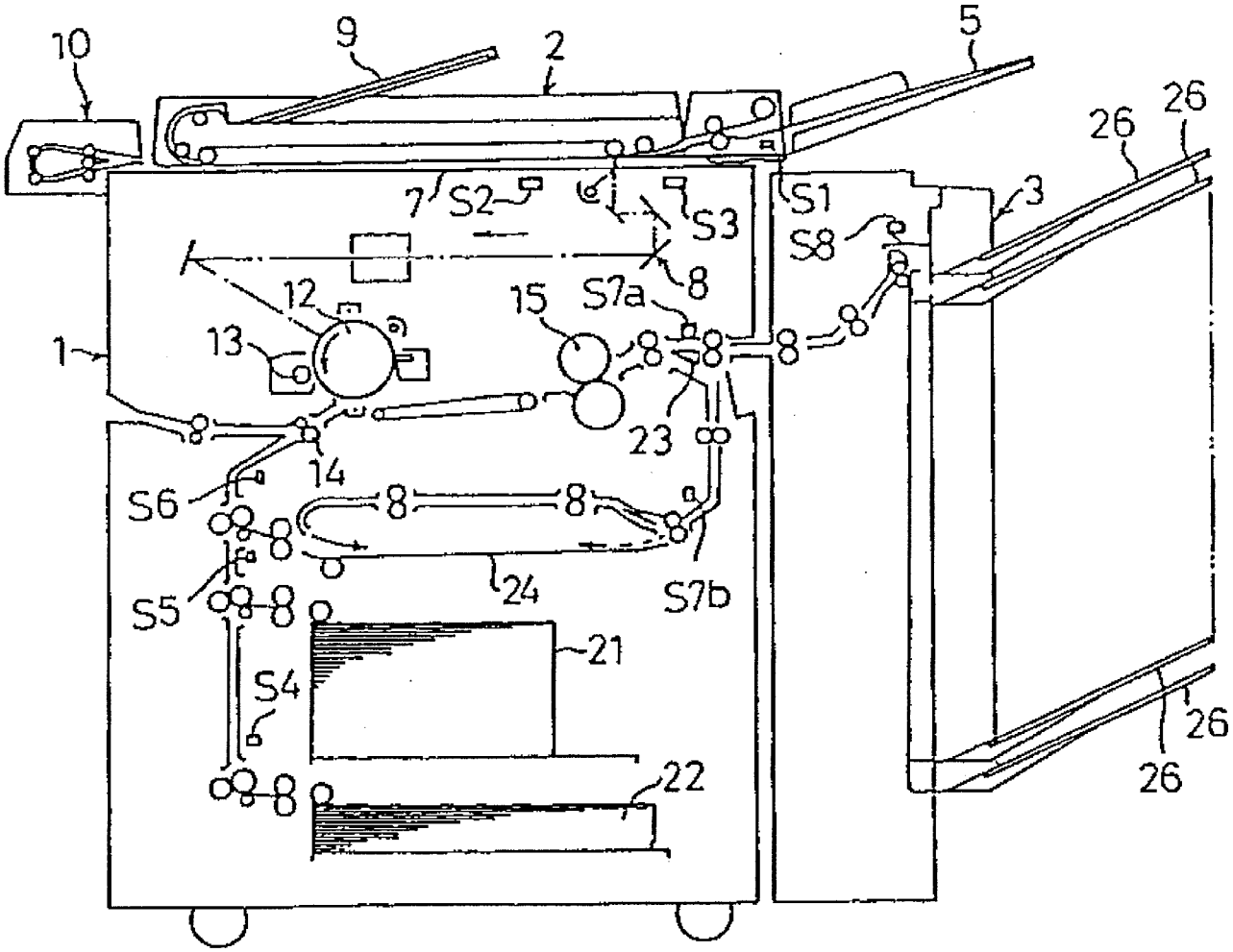
FIG. 1 is a schematic structural view showing the entire copying apparatus of an embodiment of the present invention.
Figure 2:
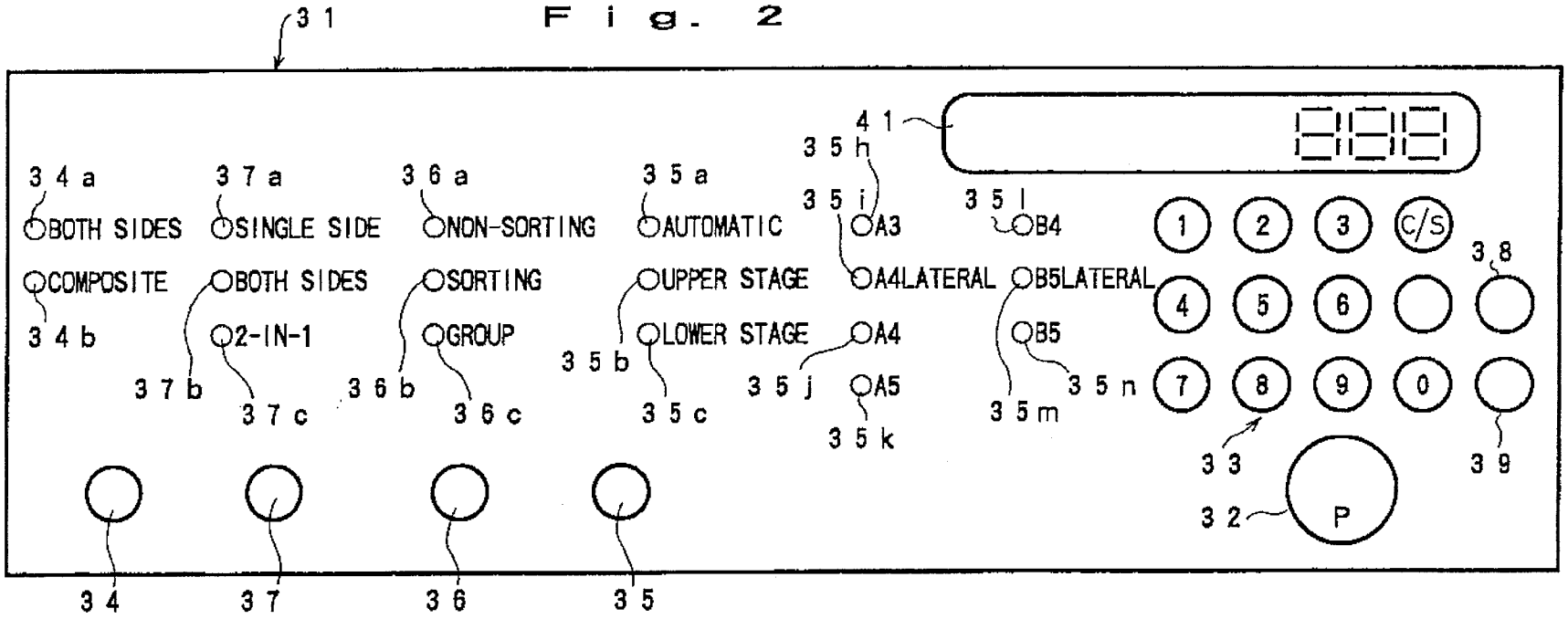
FIG. 2 is a plan view showing an operation panel of the copying apparatus.
Figure 3:
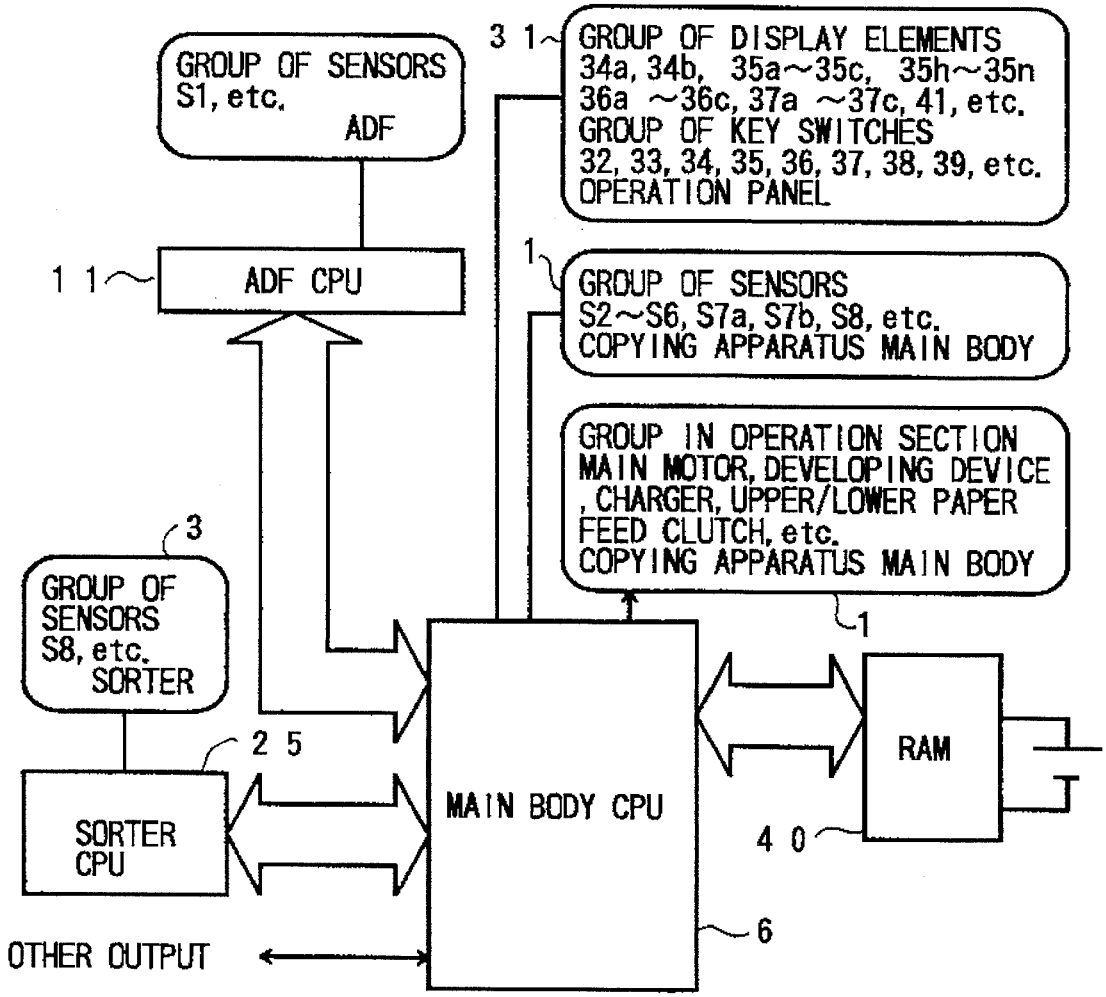
FIG. 3 is a block diagram of a control circuit of the copying apparatus.

FIGS. 1 through 3 show a schematic structure of a copying apparatus to which an embodiment of the present invention is applied.

As illustrated in FIG. 1, the copying apparatus is provided with an original feed device 2 and a sorter 3 in the main body 1. The original feed device 2 is arranged for subsequently feeding originals accommodated in an original tray 5 with original side face down to a predetermined position on a platen glass 7 of the main body 1 of the copying apparatus from an original placed uppermost corresponding to a control signal transmitted from CPU6 on the side of the main body 1 of the copying apparatus shown in FIG. 3. In this state of operation, original images are scanned by an optical system 8, and the original which has been used for a copy process is discharged onto a paper discharge try 9 from the platen glass 7.

When an original is a both-sided original, the original once transported onto the platen glass 7 is further forwarded into a reversing unit 10, and after the original is reversed, it is again transported to a predetermined position on the platen glass 7. Under such a state, original image on a second side is scanned by the optical system 8. The original whose second side has been used for a copy process is again transported into the reversing unit 10 and is reversed. Thereafter, the original is returned to a predetermined position on the platen glass 7 three times. During this operation, original image on a first side is scanned by the optical system 8, by which the first side is used for a copy process. The original whose second side and first side have been used for a copy process is discharged onto the paper discharge tray 9.

The original feed device 2 is further arranged to be able to perform two-in-one mode process wherein each image on two sheets of originals are distributively reproduced on the same side of a transfer sheet. Accordingly, when the two-in-one mode process is set, the original feed device 2 handles two sheets of originals placed in front and in the rear as if they are a continued sheet of one original when a copying process is conducted on each mode, and each image is simultaneously reproduced on the same side of a transfer sheet corresponding to each copy mode by distributing the images in front and in the rear in the original transport direction. The number of original sheets to be handled simultaneously and positional relations of originals when they are reproduced may be variably set besides the above-mentioned embodiment.

A setting of originals into the original tray 5 is detected by a first original sensor S1, and a detected signal is inputted in CPU11 on the side of the original feed device 2 shown in the FIG. 3, and thereafter, it is transmitted to the main body CPU6. An original sent to a predetermined position on the platen glass 7 is detected by a second original sensor S2 disposed adjacent to the undersurface of the platen glass 7, and the detection signal is transmitted to the main body CPU6 from the original sensor S2. The state of connection of the original feed device 2 with the main body 1 of the copying apparatus is detected, for instance, by an original feed device sensor S3.

The main body 1 of the copying apparatus performs a copy process in an electrophotographic system. More particularly, by scanning an image of original placed at a predetermined position on the platen glass 7 with the optical system 8, a reflective light from the original is led onto a photoconductive drum 12 as shown by a dash and dotted line in the FIG. 1 to perform image exposure on the photoconductive drum 12. The surface being moved to the exposure section of the photoconductive drum 12 is uniformly charged, and an electrostatic latent image corresponding to an image of original is formed by said image exposure.

An electrostatic latent image formed on the photoconductive drum 12 is developed with toner by a developing device 13, and the toner image after developing process is transferred onto a transfer sheet being fed at a predetermined timing through a register roll 14, and thereafter, the transfer sheet after transfer process receives a fixing process by a fixing device 15.

When an upper paper feed outlet is selected as a paper feed outlet, a transfer sheet is fed toward the register roller 14 from an upper paper feed cassette 21 for a transfer process. When a lower paper feed outlet is selected as a paper feed outlet, a transfer sheet is fed toward the register roller 14 from a lower paper feed cassette 22 for a transfer process.

A transfer sheet after fixing process is either discharged to a sorter 3 outside the main body 1 of the copying apparatus or accommodated into an intermediate tray 24 provided for both sides copy or composite copy process depending on the position where a changeover claw 23 is positioned, either for discharge or for accommodation.

The intermediate tray 24 is arranged to receive a transfer sheet on a first side of which an image is formed through a path illustrated by thin line in the FIG. 1 with the image face up when a both sides copy mode for copying on both sides of a transfer sheet is selected. The tray 24 is further arranged to receive a transfer sheet through a path shown by broken line in the FIG. 1 with the image face down when a composite copy mode for forming a composite image on the same side of a sheet is selected.

The transfer sheet once received by the intermediate tray 24 is again fed to the register roller section 14 to receive another transfer process for the next image forming process. At this stage, when a transfer sheet accommodated with the image face up is fed again, a second side of the transfer sheet on which image is not formed is positioned opposite to the photoconductive drum 12 for a transfer process so that an image is formed on the same side of the transfer sheet to accomplish a composite copying process.

When a transfer sheet being accommodated with the face down is fed again, a first side of the sheet on which an image is formed faces the photoconductive drum 12 for another transfer process. Accordingly, two rounds of image forming processes are performed on the same side of the transfer sheet to accomplish a composite copying process.

A transfer sheet discharged onto the sorter 3 is guided to a discharge bin 26 by control of the CPU25 on the side of the sorter illustrated in the FIG. 3. At this stage, when a sorting mode is set, the transfer sheet being subsequently discharged are sorted according to the mode set and discharged to each of the discharge bin 26.

On the upper surface of the main body 1 of the copying apparatus as constructed above, there is provided an operation panel 31 shown in the FIG. 2. On the operation panel 31, there are disposed various key switches such as a print key 32 for instructing the start of a copying operation, ten keys 33 for inputting numerical value, a copy mode key 34 for setting a copy mode either for both sides or composite copy mode, a paper feed outlet selection key 35 for selecting a paper feed outlet of a transfer sheet, a sorting mode key 36 for setting a discharge mode of a transfer sheet after copying operation, an original selection key 37 for selecting an original for single sides or both sides or two-in-one copy mode, a key 38 for inputting the number of original sheets, a key 39 for registering the number of sheets. Operation input signals of each key switch are inputted into the main body CPU6 as illustrated in the FIG. 3.

When the number of sheets registering key 39 are operated after operating the number of original sheets input key 38, a numerical value inputted by ten keys 33 is registered into a predetermined area in RAM40 connected to the main body CPU6 as the number of sheets of original.

On the operation panel 31, a group of LED elements for displaying copy modes and the like are provided besides a display section 41 which displays a numerical value of the number of copy sheets, and their lamps are controlled by signals from the main body CPU6 as shown in the FIG. 3.

More particularly, numerals 34*a* and 34*b* represent LED elements for turning on a light to display a copy mode selected, and they are provided for both sides and composite copy modes. Numerals 35*a* through 35*c* represent LED elements for turning on a light to display a mode selected at paper feed outlet, and numerals 35*h* through 35*n* represent LED elements for switching on and displaying the size of a transfer sheet accommodated in a selected paper feed outlet. Numerals 36*a* through 36*c* represent LED elements for displaying a kind of mode selected for the sorter 3, and in the present embodiment, each of non-sorting, sorting and group copy modes is displayed. Numerals 37*a* and 37*b* represent LED elements for turning a light to display a kind of original selected. While numeral 37*c* represents an LED element for turning on a light to display that an original is to be treated in two-in-one mode.

The state of each mode selection is stored in RAM40 which is backed up by battery as shown in the FIG. 3. The main body CPU6 controls each operation section in the main body 1 of the copying apparatus as shown in the FIG. 3 besides the control for displaying each mode.

The main operational control will now be described referring to flowcharts shown in the FIGS. 4 through 15. In the description, 'on edge' means a state when a signal has been changed from off state to on state, while 'off edge' means a state when a signal has been changed from on state to off state.

Figure 4:
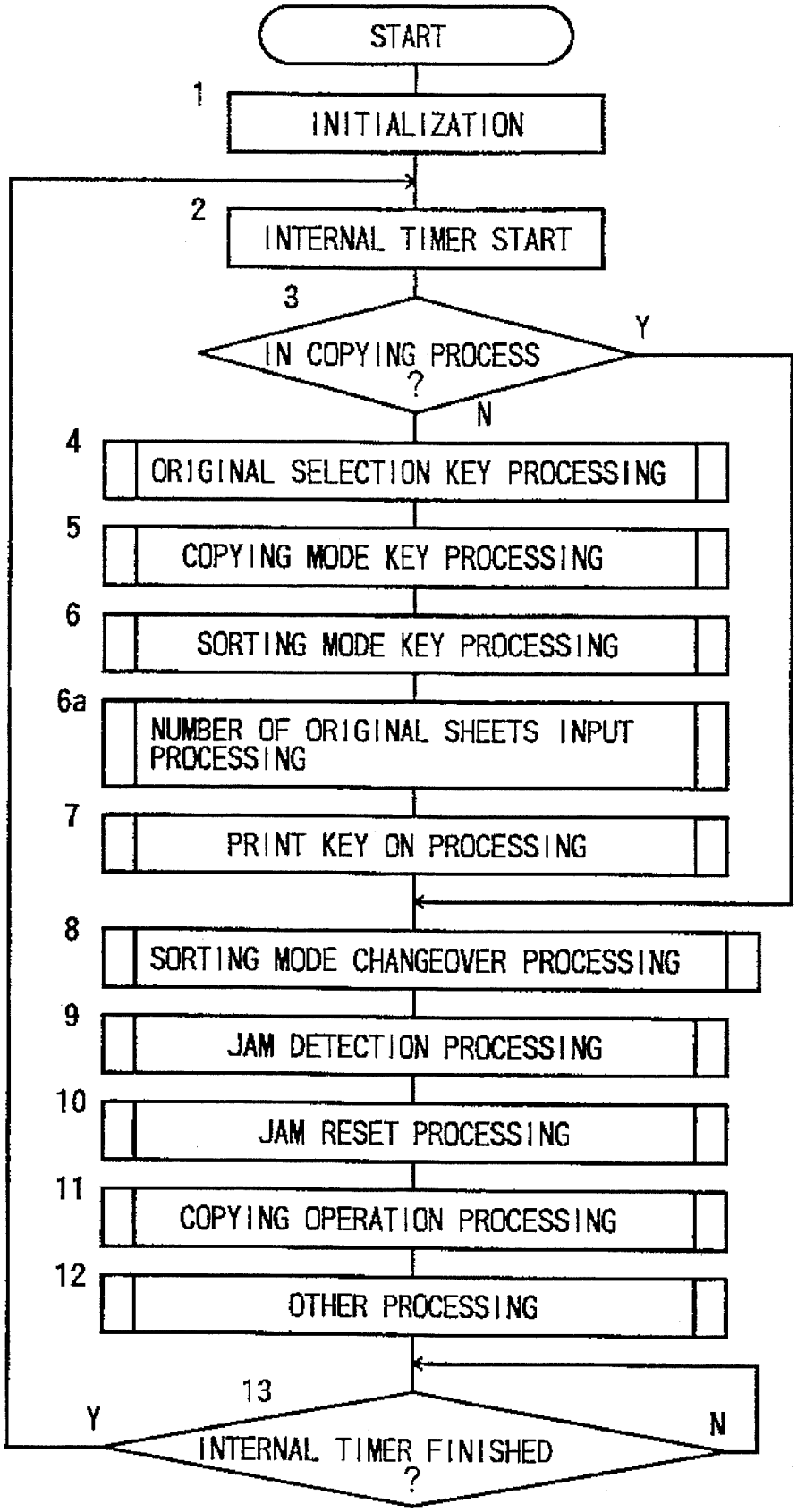
FIG. 4 is a flowchart showing a main routine of operational control of the control circuit.

FIG. 4 is a flowchart showing a main routine of operational control in the main body CPU 6 which will be described hereinafter.

The main body CPU6 starts a processing, for instance, by applying electricity, and an initialization such as clearance of RAM40 is made (step #1). Then, a program is repeated from steps #2 through #13 to execute processing in a loop. More particularly, an internal timer for controlling an execution time in one routine is started (step #2) to conduct the following processes;

original selection key processing subroutine (step #4):
this process is executed under a condition that copying process is not being conducted, and each time the original selection key 37 is pressed, each mode set for single sided original, both sided original, two-in-one original is subsequently changed.

copy mode key processing subroutine (step #5):
this process is executed under a condition that copying process is not being conducted, and each time the copy mode key 34 is pressed, both sides and composite copy mode are changed.

sorting mode key processing subroutine (step #6):
this process is executed under a condition that copying process is not being conducted, and each time the sorting mode key 36 is pressed, a mode for operating the sorter is changed.

the number of original sheets input processing subroutine (step #6*a*):
accompanying with an operation of the number of original sheets input key, this process makes it possible to set the number of original sheets and also to register the number of original sheets set.

print key turning on processing subroutine (step #7):
this process is executed under a condition that copying process is not being conducted, and the process is executed when the print key 32 is pressed.

sorting mode changeover processing subroutine (step #8):
sorting mode is automatically changed based on the number of original sheets.

jam detection processing subroutine (step #9):
jam detection of a transfer sheet is processed.

jam reset processing subroutine (step #10):
jam reset of a transfer sheet is processed.

copying operation processing subroutine (step #11):
various operations to be performed along with a copying process are processed.

other processing subroutine (step #12):
besides the above-mentioned processing, other processing such as grouping process are collectively executed by the main CPU6.

After all the above processing are executed, the program returns to step #2 upon completion of the internal timer (step #13), and the program is repeated.

Figure 5:
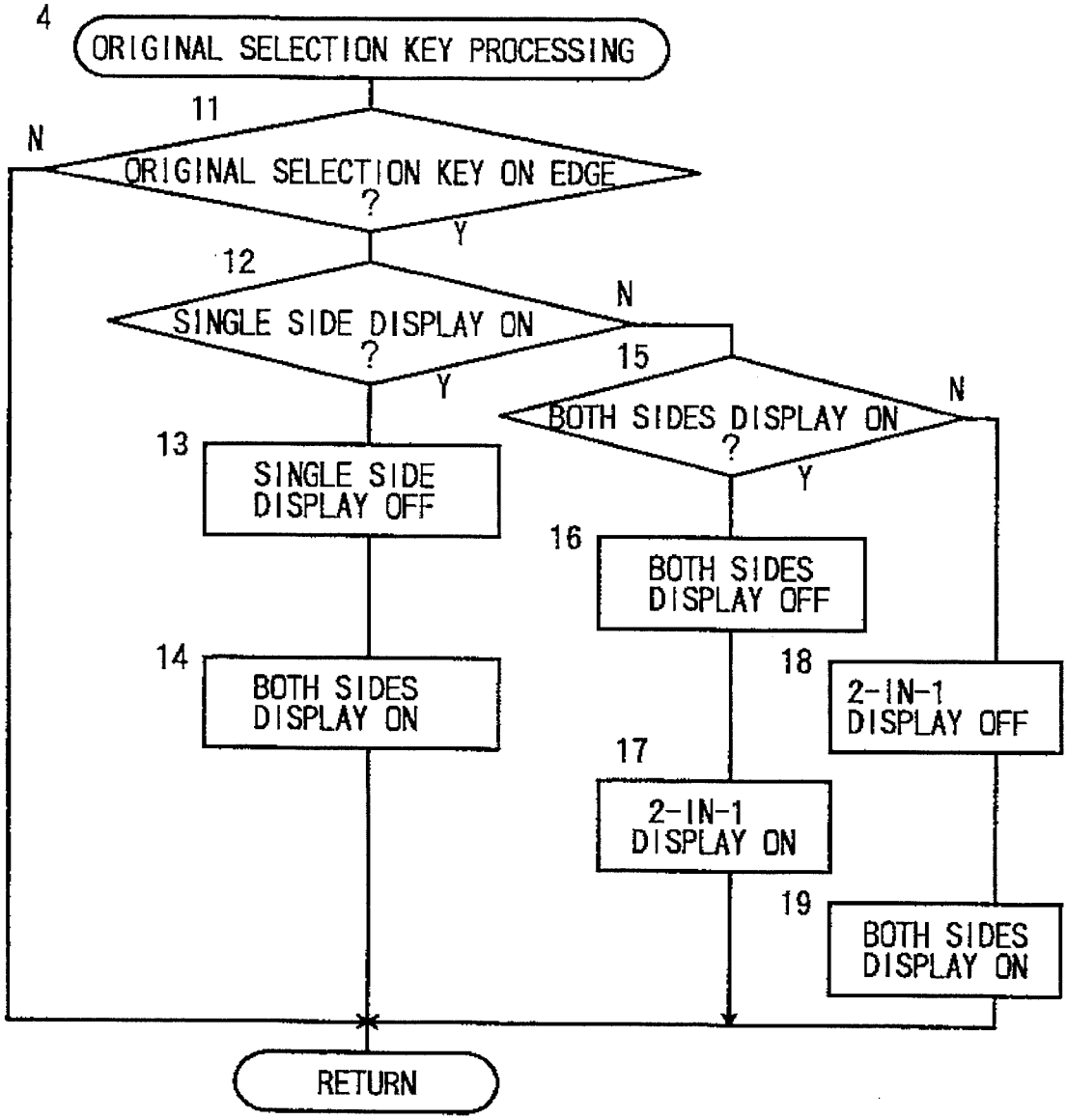
FIG. 5 is a flowchart showing an original selection key processing subroutine in the FIG. 4.

FIG. 5 is a flowchart showing more in detail the original selection key processing subroutine at step #4. This process is executed when the original selection key 37 is on edge (step #11), and judgement is made whether the LED element 37*a* which displays single sided original is turned on or not (step #12). When it is turned on, the single sided original display by the LED element 37*a* is turned off and the LED element 37*b* which displays both sided original is turned on to change the state of single sided original selection to the state of both sided original selection (steps #13, #14).

If the LED element 37*a* which displays single sided original is turned off at step #12, judgement is made whether the LED element 37*b* which displays both sided original is turned on or not (step #15). When it is turned on, both sided original display by the LED element 37*b* is turned off, and the LED element 37*c* which displays two-in-one mode is turned on to change the state of both sided original selection to the state of two-in-one selection mode (steps #16, #17). If the LED element 37*b* which displays both sided original is turned off at step #15, the LED element 37*c* which displays two-in-one mode is turned off, and the LED element 37*a* which displays single sided original is turned on to change the state of two-in-one mode selection to the state of single sided original selection (steps #18 #19).

Figure 6:
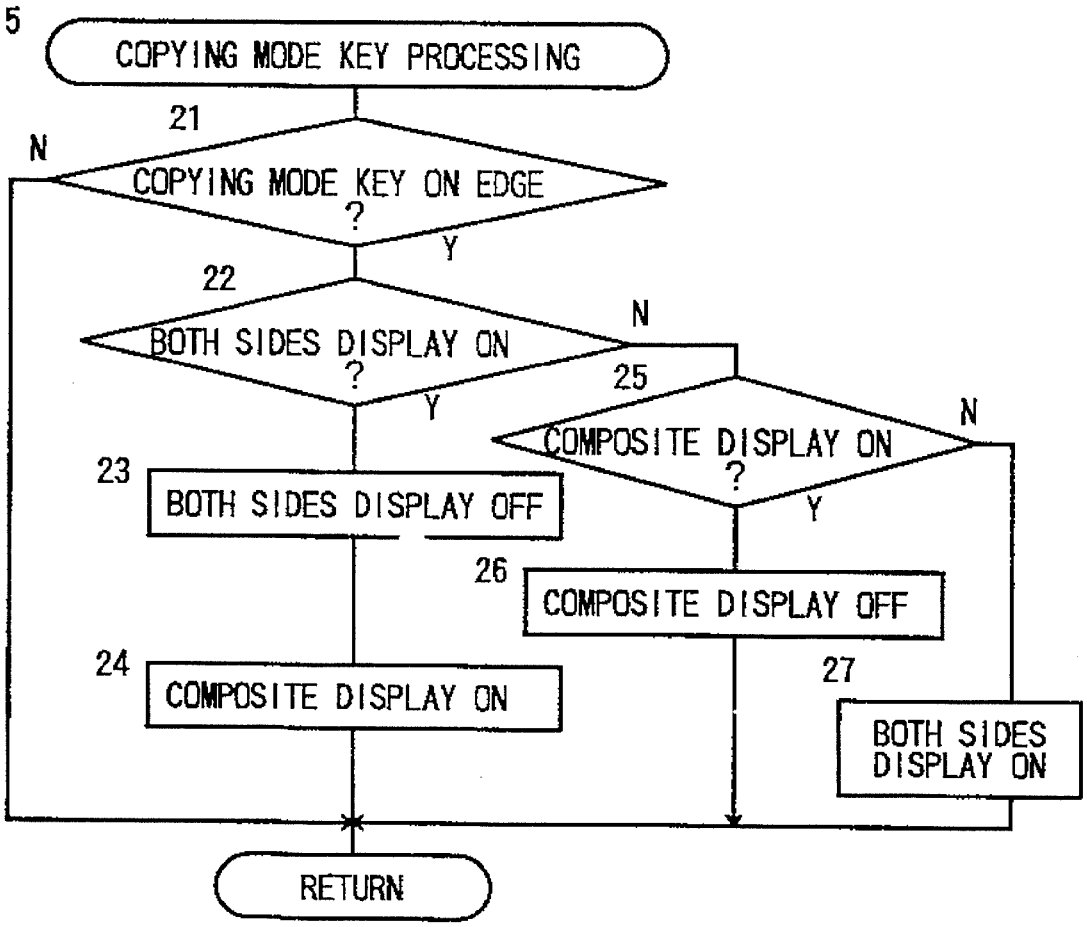
FIG. 6 is a flowchart showing a copy mode key processing subroutine in the FIG. 4.

FIG. 6 is a flowchart showing more in detail the copy mode key processing subroutine at step #5. This process is executed when the copy mode key 34 is on edge (step #21), and judgement is made whether the LED element 34*a* which displays both sides copy mode is turned on or not (step #22).

When it is turned on, the LED element 34*a* which displays both sides copy mode is turned off, and by turning on the LED element 34*b* which display composite copy mode (steps #23, #24), the state of both sides copy mode selection is changed over to the state of composite copy mode selection.

If the LED element 34*a* which displays both sides copy mode is not turned on at step #22, judgement is made whether the LED element 34*b* which displays composite copy mode is turned on or not (step #25). When it is turned on, the LED element 34*b* which displays composite copy mode is turned off to release the state of composite copy mode selection (step #26). The program is thus returned to an ordinary mode wherein neither both sides copy mode nor composite copy mode is not selected. When the LED element 34*b* which displays composite copy mode is not turned on at step #25, the LED element 34*a* which displays both sides copy mode is turned on to change over to the state of both sides copy mode selection (step #27). Copy mode is thus changed over subsequently each time the copy mode key 34 is pressed.

Figure 7:
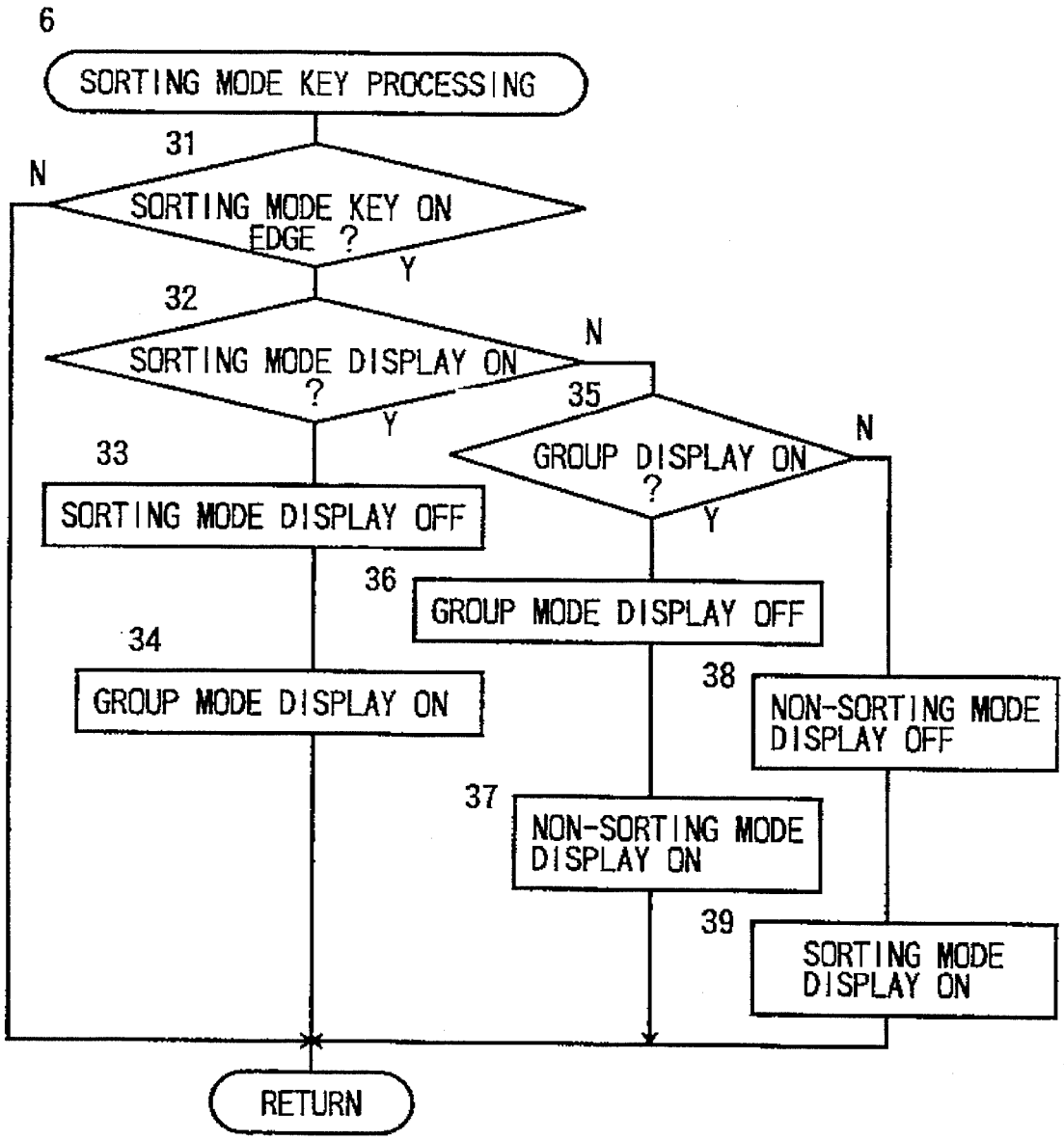
FIG. 7 is a flowchart showing a sorting mode key processing subroutine in the FIG. 4.

FIG. 7 is a flowchart showing more in detail the sorting mode key processing subroutine at step #6. The process is executed when the sorting mode key 36 is on edge (step #31), and judgement is made whether the LED element 36*a* which displays sorting mode is turned on or not (step #32). When it is turned on, the LED element 36*a* which displays sorting mode is turned off, and by turning on the LED element 36*b* which displays group mode (steps #33, #34), the state of sorting mode selection is changed to the state of group mode selection.

If the LED element 36*a* which displays sorting mode is not turned on at step #32, judgement is made whether the LED element 36*b* which displays group mode is turned on or not (step #35). When it is turned on, the LED element 36*b* which display group mode is turned off, and by turning on the LED element 36*c* which displays non-sorting mode (steps #36, #37), the state of group mode selection is changed to the state of non-sorting mode selection. If the LED element 36*c* which display group mode is not turned on at step #35, the LED element 36*c* which display non-sorting mode is turned off, and by turning on the LED element 36*a* which displays sorting mode, the state of non-sorting mode selection is changed to the state of sorting mode selection. Available modes for the sorter 3 are thus changed subsequently each time the sorting mode key 36 is pressed.

Figure 8:
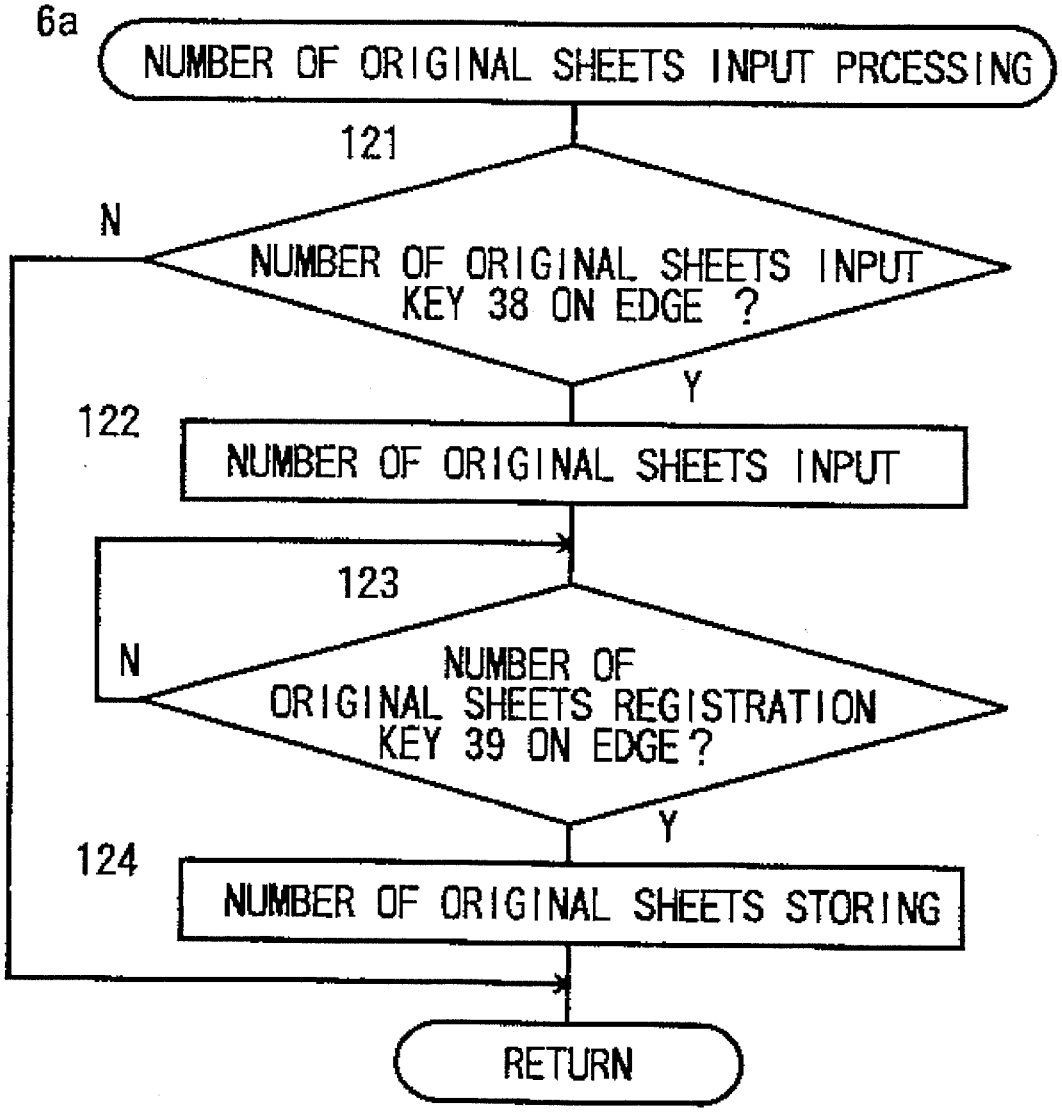
FIG. 8 is a flowchart showing the number of sheets of original input processing subroutine in the FIG. 4.

FIG. 8 is a flowchart showing the number of original sheets input processing subroutine at step #6*a*. The process is executed when the number of original sheets input key 38 is on edge (step #121), and the number of original sheets to be set are inputted by ten keys 33 (step #122). Then, if the number of sheets registering key 39 is on edge (step #123), the number of original sheets inputted is stored in a memory (step #124).

Figure 9:
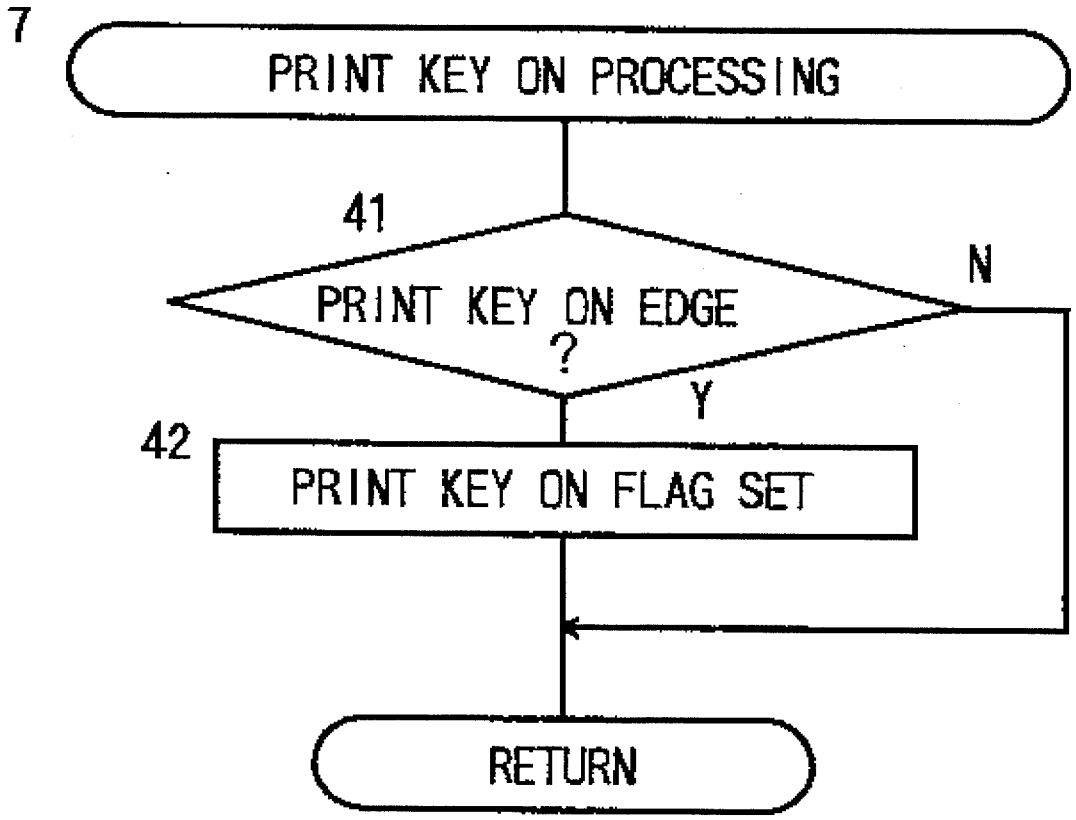
FIG. 9 is a flowchart showing a print key on processing subroutine in the FIG. 4.

FIG. 9 is a flowchart showing more in detail the print key turning on processing subroutine at step #7. The process is executed when the print key 32 is on edge (step #41), and a print key on flag is set.

Figure 10:
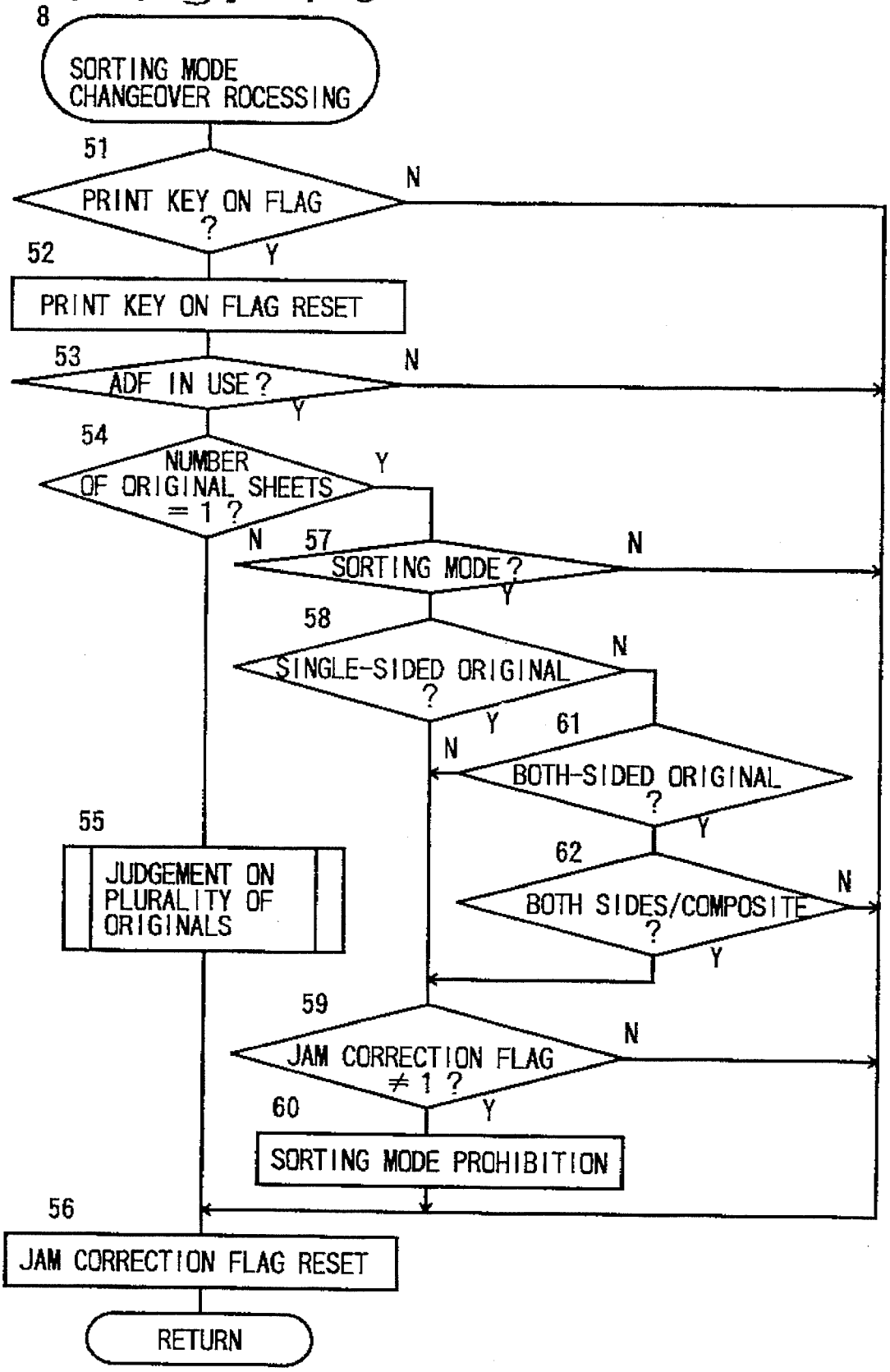
FIG. 10 is a flowchart showing a sorting mode changeover processing subroutine in the FIG. 4.

FIG. 10 is a flowchart showing more in detail the sorting mode changeover processing subroutine at step #8. In the present embodiment, the original feed device 2 is arranged to forward an original from the original tray 5 for copying process, and thereafter, the original is discharged to another paper discharge tray. In other words, originals are fed in a non-circulating system. The number of sheets accommodated in the original tray can therefore be detected automatically by idly transporting originals in the original feed device. However, it is necessary to return the originals discharged onto the paper discharge tray 9 by the idle feeding to the original tray 5 again. Accordingly, when the original feed device 2 is used, it is arranged, in the present embodiment, to conduct the sorting mode changeover processing corresponding to the combination of a kind of original, the number of sheets and copy mode on the condition that the number of sheets are set by an operator.

An original feed device arranged for a circulating system may also be utilized wherein an original fed from the original tray 5 is discharged to said original tray 5 after an original has been used for copying process. In other words, the same tray is used as an original tray 5 and a discharge tray.

Further, in the apparatus of the present embodiment, it may also be arranged to be set for an ordinary sorting mode or a non-sorting mode.

More particularly, as illustrated in FIG. 10, the process is executed when sorting mode is selected and a print key on flag is set (step #51), and after the print key on flag is reset (step #52), judgement is made whether the original feed device 2 is used or not (step #53). In the case when the original fee device 2 is not used, it is not known how many sheets of originals are manually placed by an operator and judgement can not be made as to whether sorting mode has to be prohibited or not. A program is therefore returned to the main routine through a process of resetting a jam correction flag at step #56.

When the original feed device 2 is used, there is a case when sorting mode has to be prohibited depending on original mode and copy mode. Processes at steps #54 through #62 are therefore conducted. At step #54, judgement is made whether there are a plurality of originals or not. If there are a plurality of originals, there are cases when sorting mode has to be prohibited and not needed to prohibit the sorting mode depending on a copy mode. Therefore, in the plural originals judgement processing subroutine at step #55, when there are a plurality of originals, judgement peculiar to the case of plural originals and mode changeover processing are conducted. Thereafter, the program is returned to the main routine (step #56) after jam correction flag reset processing is conducted.

When original is not plural, judgement is first made whether sorting mode is selected or not (step #57). If the sorting mode is not selected, there is no problem at all so that the program is returned through a process of jam correction flag reset at step #56. However, when sorting mode is selected, judgement is made whether the original is single sided or both sided at steps #58, #61, or two-in-one mode (step #58). When original is judged as single sided at step #58, and when the original is two-in-one mode, not both sided original at step #61, sorting mode is prohibited (steps #59, #60) on the condition that jam correction flag is not set since the original is one and corresponding transfer sheet is one irrespective of copy mode, and the program returns to the main routine after jam correction flag reset processing at step #56 is conducted as the previous processing.

If original is both sided original, judgement is made whether copy mode is for both sides or composite copy mode at step #62. In the case of both sides or composite copy mode, sorting mode is prohibited on the condition that jam correction flag is not set at steps #59, #60 since one sheet of transfer sheet is sufficient even if one sheet of original is both sided original, and the program returns to the main routine through step #56. If a mode is not for both sides or composite copy mode at step #62, the program returns to the main routine through step #56 since two sheets of transfer sheet are required for copying both sides of one sheet of original.

Figure 11:
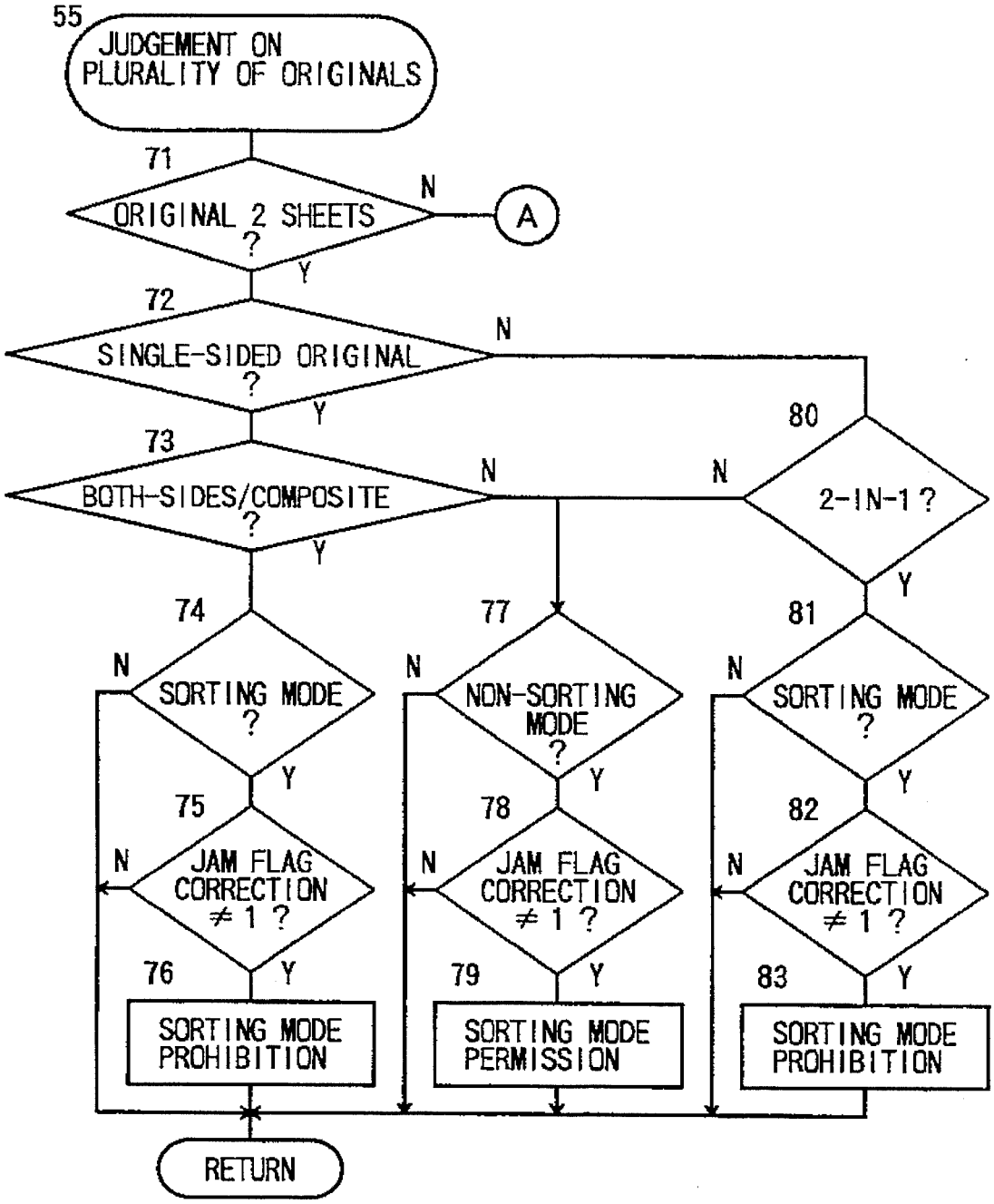
FIG. 11 is a flowchart showing a part of a plurality of originals judging processing subroutine in the FIG. 10.

FIG. 11 is a flowchart showing more in detail the plural originals judgement processing subroutine at step #55 in the FIG. 10. The process is executed when original is judged as plural at step #54 in the FIG. 10. At step #71, judgement is made whether plural originals are two sheets or not. When the original is judged as two sheets, then judgement is made whether it is a single sided original or not (step #72). When two sheets of originals are single sided, and both sides and composite copy modes are selected (step #73), sorting mode is prohibited (steps #74 through #76) on the condition that sorting mode is selected and jam correction flag is reset.

If both sides and composite copy modes are not selected at step #73, sorting mode is permitted on the condition that jam correction flag is reset even if non-sorting mode is selected so that two sheets of single sided original can be applied (steps #77 through #79).

If original is not a single sided original at step #72, and is for two-in-one mode process (step #80), sorting mode is prohibited on the condition that sorting mode is selected and jam correction flag is reset (steps #81 through #83). In the case when original is found not for two-in-one mode process at step #80, sorting mode is permitted like in the previous steps #77 through #79.

Figure 12:
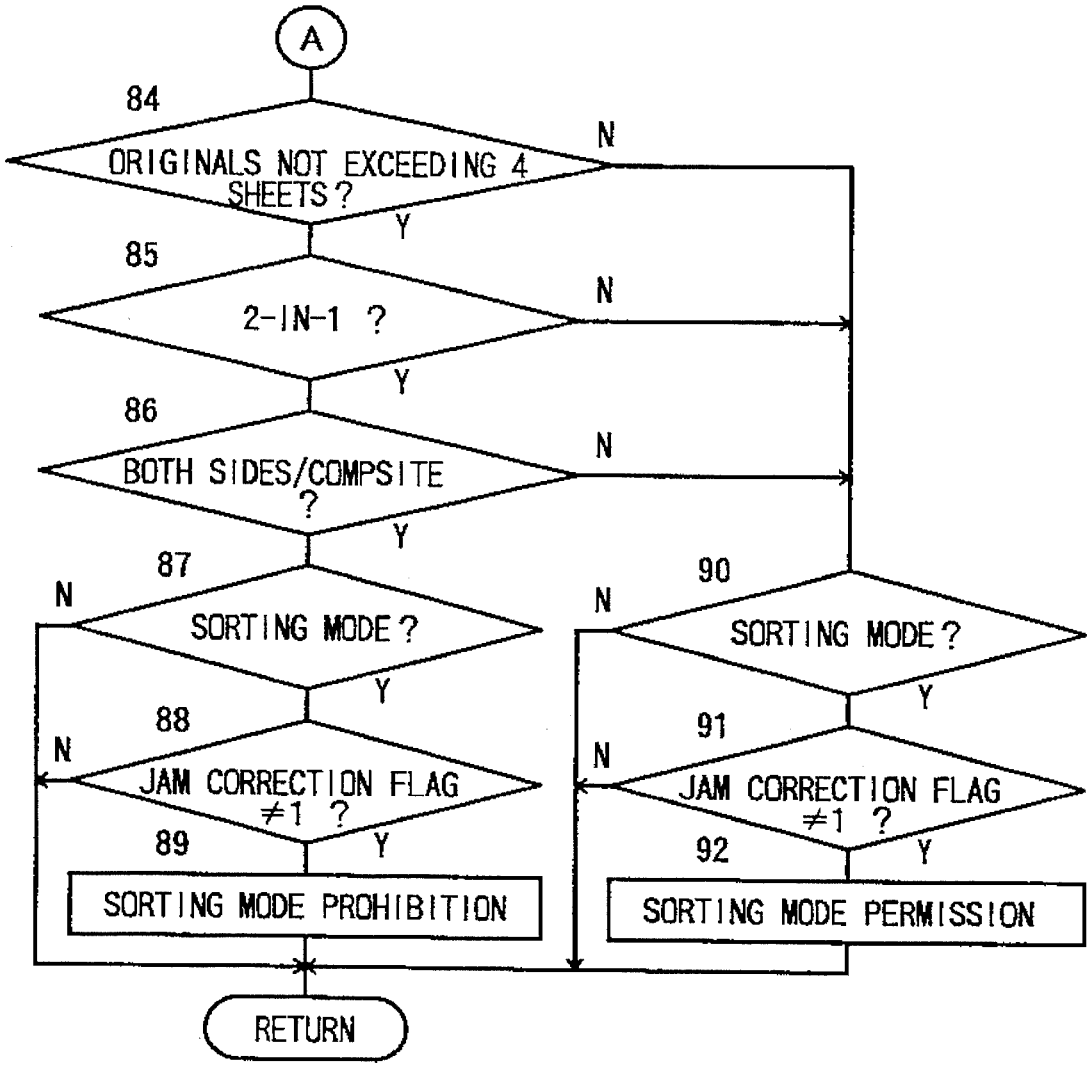
FIG. 12 is a flowchart showing the remaining part of a plurality of originals judging processing subroutine in the FIG. 10.

If original is not two sheets at step #71, judgement is made whether the sheets are not more than four sheets or not at step #84 shown in the FIG. 12. When original is found not more than four sheets, that is, three or four sheets, it means that the original is for two-in-one mode process (step #85), and only when both sides and composite copy modes (step #86) sorting mode is prohibited on the condition that sorting mode is selected and jam correction flag is reset since one sheet of transfer sheet is sufficient (steps #87 through #89). Sorting mode is permitted in other cases.

In other words, when original is not more than four sheets (step #84) and in the case when the original is not for two-in-one mode process even if it is less than four sheets (step #84), and in the case when the original is for both sides and composite copy modes (step #86) even if it is less than four sheets and is not for two-in-one mode, sorting mode is permitted on the condition that non sorting mode is selected and jam correction flag is reset, and the program returns to the sorting mode changeover processing subroutine (steps #90 through #92). With such an arrangement, sorting mode processing is prevented when one sheet of transfer sheet is used by original mode and copy mode.

Figure 13:
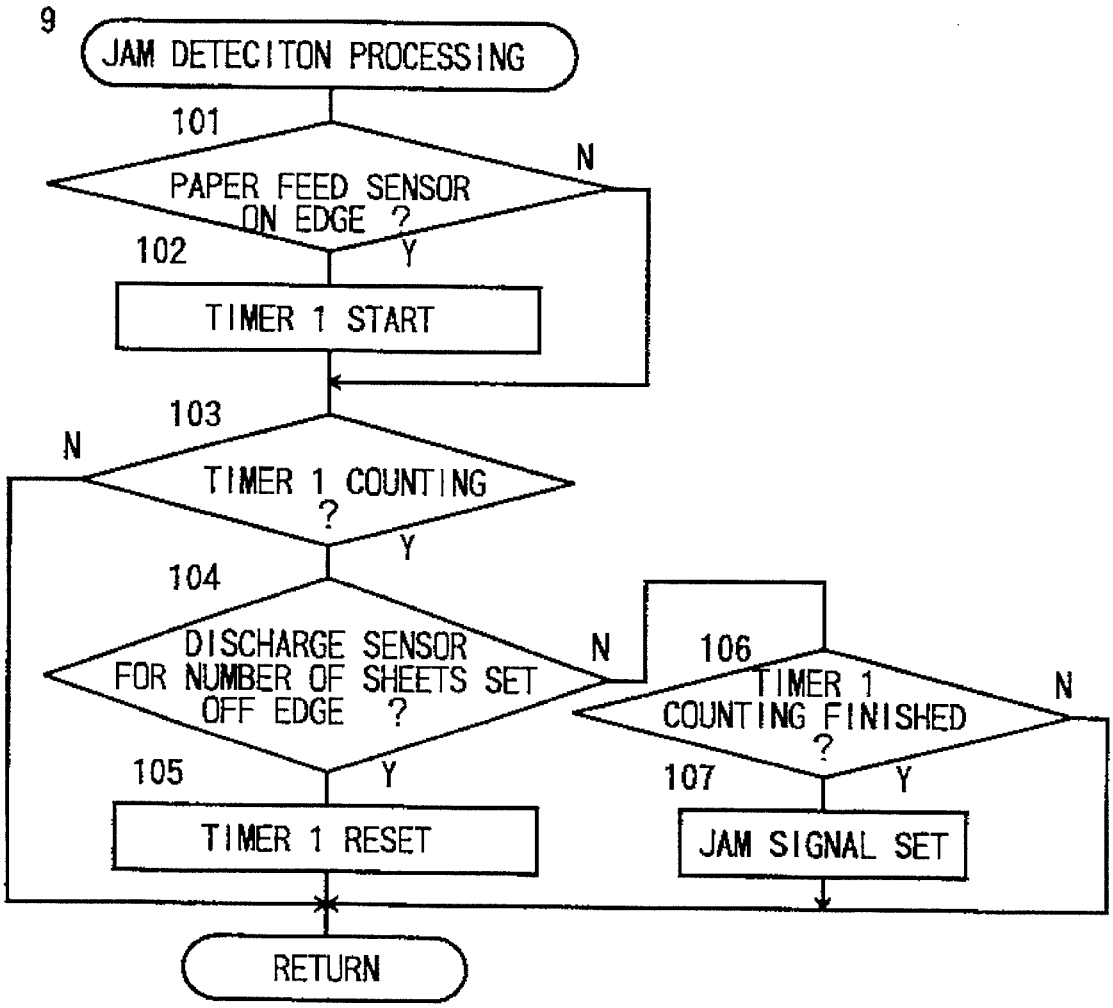
FIG. 13 is a flowchart showing a jam detection processing subroutine in the FIG. 4.

FIG. 13 is a flowchart showing more in detail the jam detection processing subroutine at step #9 in the FIG. 4. In this process, a timer 1 provided for detecting jam is started at a timing of on edge at any one of the paper feed sensors S4–S6 (steps #101, #102). At this stage, a time $\alpha$ required for the timer 1 from the start of paper feeding at each paper feed outlet 21, 22 or intermediate tray 24 to the completion of paper discharge is separately set. When the timer 1 is in the process of counting (step #103), and if an off edge at the discharge sensor S8 of the sorter 3 is detected for the number of sheets set, the timer 1 is reset to finish a jam detection process. When a counting process of the timer 1 is finished (step #106) before an off edge at the discharge sensor S8 is detected for the number of sheets set, a jam signal is set (step #107).

Figure 14:
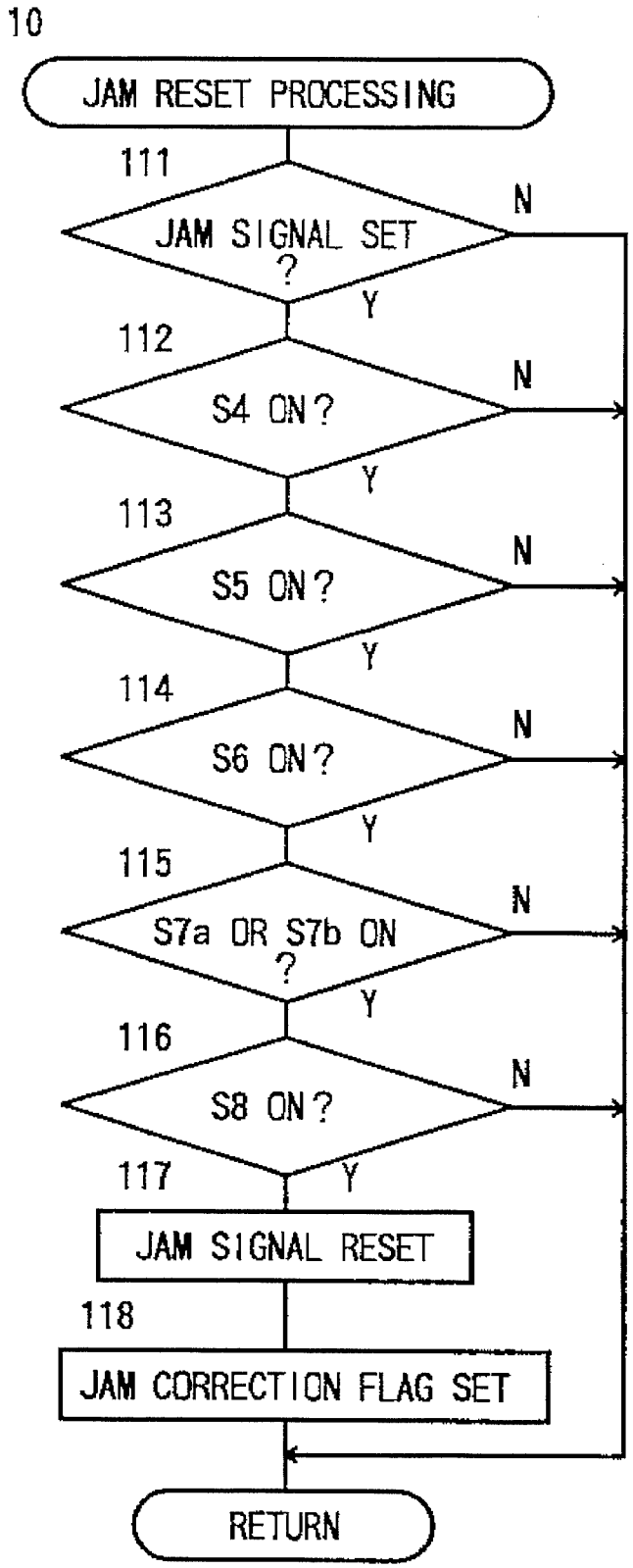
FIG. 14 is a flowchart showing a jam reset processing subroutine the FIG. 4.

FIG. 14 is a flowchart showing more in detail the jam reset processing subroutine at step #10 in the FIG. 4. This process is executed when jam signal is set. Jam signal is reset (step #117) when jam signal is set and all of the sensors S4–S8 are turned on (steps #111–#116), and then, a jam correction flag is set (step #118).

Figure 15:
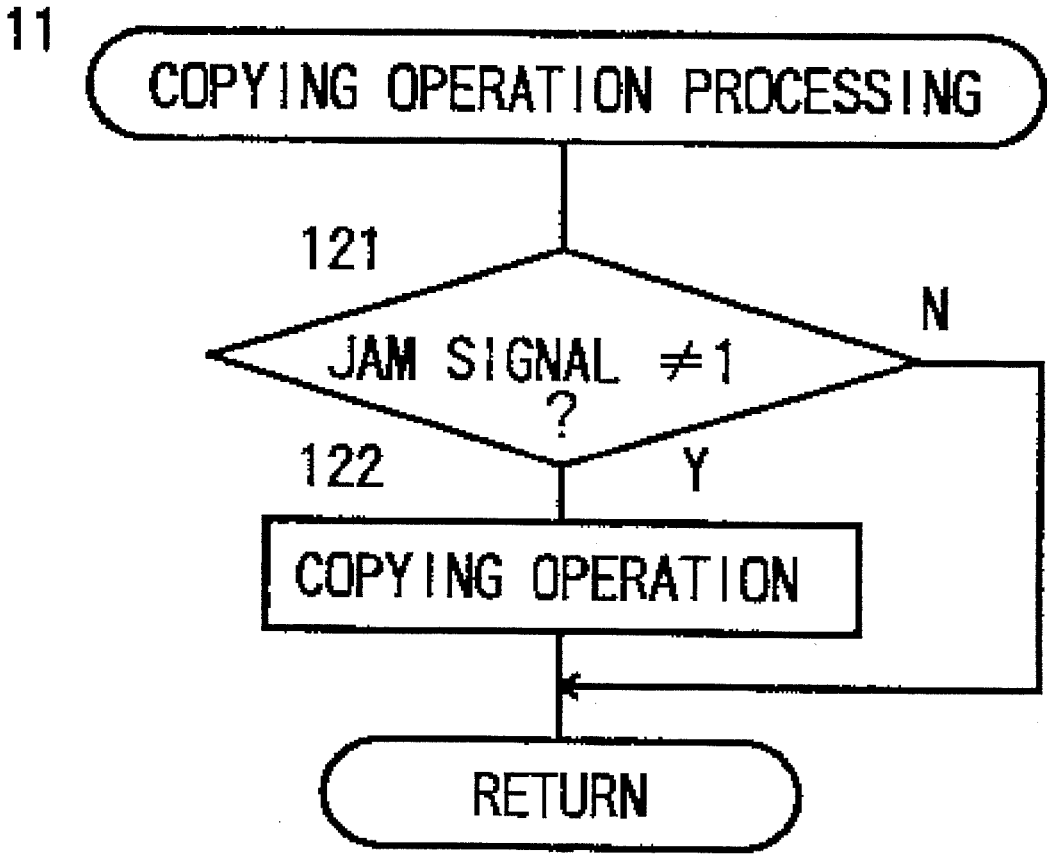
FIG. 15 is a flowchart showing a copying operation processing subroutine in the FIG. 4.

FIG. 15 is a flowchart showing more in detail the copying operation processing subroutine at step #11 in the FIG. 4. In this process, each processing for executing a copying operation (step #122) is processed when the jam signal is not set (step #121).

According to control processes as described above, judgement is made whether the whole original can be transferred on one sheet of transfer sheet from original mode and copy mode set, and if it is possible, sorting mode is prohibited. Even if an original is both sided and in a plurality of sheets which requires more than two transfer sheets in an ordinary copy mode, sorting mode can also be prohibited when reproduction can be made in one transfer sheet from a copy mode so that inconveniences for taking out transfer sheets from each of the discharge bins can be prevented.

Furthermore, in the case when the whole original can be reproduced on one transfer sheet, a mode set during a copying process is prevented from being changed with an arrangement not to prohibit sorting mode when a copying process is started after jam trouble has been cleared, and troubles arising from prohibition of sorting mode can be avoided.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An apparatus for producing copies of originals, comprising:

sorting means provided with a plurality of paper discharge sections for receiving produced copies, said means being operable in a sorting mode and a non-sorting mode;

identifying means for identifying the number of originals to be copied;

selecting means for selecting one of a plurality of copy modes, said plurality of copy modes including a specific copy mode for copying images of a plurality of originals on one sheet, and another copy mode for copying an image of one original on one side of a sheet;

executing means for executing the copying operation of the copy mode selected by said selecting means;

determining means for determining whether images of all of a plurality of originals to be copied can be produced on one sheet when the specific copy mode is selected by said selecting means; and prohibiting means for prohibiting execution of said sorting mode in the specific copy mode when said determining means determines that a copy of all of the originals to be produced can be formed on one sheet.

2. The apparatus as defined in claim 1, wherein the sorting means is a sorter provided with a plurality of bins.

3. The apparatus as defined in claim 1, further comprising means for setting the number of sheets of originals.

4. The apparatus as defined in claim 1, further comprising means for automatically feeding a predetermined number of sheets of originals for a copying process.

5. The apparatus as defined in claim 4, further comprising means for automatically detecting the number of sheets of originals by idly transporting originals set by the automatic original feed means.

6. The apparatus as defined in claim 5, wherein the automatic original feed means being arranged in a non-circulating transport system for forwarding originals set in an original tray for a copying process and thereafter discharging the originals onto another discharge tray.

7. The apparatus as defined in claim 5, wherein the automatic original feed means being arranged in a circulating transport system for transporting originals set in an original tray for a copying process and thereafter discharging the originals onto said original tray.

8. The apparatus as defined in claim 1, wherein the images of the plurality of originals are composed and copied on one sheet in the specific copy mode.

9. The apparatus as defined in claim 1, further comprising means for preferentially setting a sorting mode.

10. An apparatus for producing copies of originals, comprising:

sorting means provided with a plurality of paper discharge sections for receiving produced copies, said means being operable in a sorting mode and a non-sorting mode;

first identifying means for identifying a kind of original;

second identifying means for identifying the number of sheets of originals;

third identifying means for identifying a copy mode; and control means for prohibiting execution of a sorting mode corresponding to the identification of said three identifying means.

11. An apparatus for producing copies of originals, comprising:

feeding means for feeding originals to be copied to an exposure position;

sorting means provided with a plurality of paper discharge sections for receiving produced copies, said sorting means being operable in a sorting mode and a non-sorting mode;

selecting means for selecting one of a plurality of copy modes, a plurality of said copy modes including a specific copy mode for reproducing images of a plurality of originals fed by said feeding means on one sheet, and another copy mode for reproducing an image of originals fed by said feeding means on one side of a sheet;

counting means for counting the number of originals to be fed by said feeding means;

executing means for executing the copying operation of the copy mode selected by said selecting means;

determining means for determining whether images of all of a plurality of originals to be copied can be produced on one sheet when the specific copy mode is selected by said selecting means; and prohibiting means for prohibiting execution of said sorting mode in the specific copy mode when said determining means determines that a copy of all of the originals to be produced can be formed on one sheet.

12. The apparatus as defined in claim 11, wherein said sorting means is a sorter provided with a plurality of bins.

13. The apparatus as defined in claim 11, further comprising means for preferentially setting a sorting mode.

14. An apparatus for producing copies of originals, comprising:

a sorter provided with a plurality of bins for receiving produced copies, said sorter being operable in a sorting mode and a non-sorting mode;

identifying means for identifying the number of originals to be copied;

selecting means for selecting one of a plurality of copy modes, the plurality of copy modes including a specific copy mode for copying images of a plurality of originals on one sheet, and another copy mode for copying an image of an original on one side of a sheet;

executing means for executing the copying operation of the copy mode selected by said selecting means;

determining means for determining whether images of all of a plurality of originals to be copied can be produced on one sheet when the specific copy mode is selected by said selecting means; and means for prohibiting execution of said sorting mode when a copy of all of the originals to be produced can be formed on one sheet;

suspending means for suspending a copying process when a trouble has occurred; and control means for controlling not to prohibit execution of a sorting mode even if said determining means determines that images of all of the plurality of originals to be copied can be produced on one sheet when a copying process resumes after the trouble has been cleared.

15. The apparatus as defined in claim 14, wherein the images of a plurality of originals are composed and copied on one sheet in the specific copy mode.

16. The apparatus as defined in claim 14, further comprising means for preferentially setting a sorting mode.

17. The apparatus as defined in claim 8, wherein the images are copied on only one side of the one sheet.

18. The apparatus as defined in claim 8, wherein the images are copied on both sides of the one sheet.

19. The apparatus as defined in claim 15, wherein the images are copied on only one side of the one sheet.

20. The apparatus as defined in claim 15, wherein the images are copied on both sides of the one sheet.

21. An apparatus for producing copies of originals, comprising:

sorting means provided with a plurality of paper discharge sections for receiving produced copies, said sorting means being operable in a sorting mode and a non-sorting mode;

means for identifying the number of sheets of originals to be copied;

selecting means for selecting one of a plurality of copy modes, said plurality of copy modes including at least a specific copy mode for copying images of originals on both sides of a sheet;

executing means for executing the copy mode selected by said selecting means; and prohibiting means for prohibiting execution of said sorting mode based on the copy mode selected by said selecting means and the number of a plurality of original sheets to be copied.

22. The apparatus ad defined in claim 21, wherein said plurality of copy modes further includes another copy mode for copying images of a plurality of originals on one sheet.

23. The apparatus as defined in claim 22, wherein the images of a plurality of originals are composed and copied on one sheet in the specific copy mode.

24. The apparatus as defined in claim 23, wherein the images are copied on only one side of the one sheet.

25. The apparatus as defined in claim 23, wherein the images are copied on both sides of the one sheet.

26. An apparatus for producing copies of originals, comprising:

sorting means provided with a plurality of paper discharge sections for receiving produced copies, said means being operable in a sorting mode and a non-sorting mode;

identifying means for identifying the number of originals to be copied;

selecting means for selecting one of a plurality of copy modes, said plurality of copy modes including at least a specific copy mode for copying images of a plurality of originals on one sheet;

executing means for executing the copy mode selected by said selecting means; and prohibiting means for prohibiting execution of said sorting mode based on the copy mode selected by said selecting means and the number of a plurality of original sheets to be copied.

27. The apparatus as defined in claim 26, wherein the images of a plurality of originals are composed and copied on one sheet in the specific copy mode.

28. The apparatus as defined in claim 27, wherein the images are copied on only one side of the one sheet.

29. The apparatus as defined in claim 27, wherein the images are copied on both sides of the one sheet.

30. The apparatus as defined in claim 26, wherein said plurality of copy modes further include a copy mode for copying images of originals on both sides of a sheet.

31. An apparatus for producing a plurality of sets of copies of originals, comprising:

sorting means provided with a plurality of paper discharge sections for receiving produced copies;

determining means for determining whether each set of copies includes only one copy sheet or a plurality of copy sheets;

automatic control means for controlling said sorting means to discharge said one copy sheet to be produced into one specific paper discharge section when said determining means determines that each set of copies includes only one copy sheet, and controlling said sorting means to discharge distributively said plurality of sets of copy sheets in said plurality of paper discharge sections when said determining means determines that each set of copies includes a plurality of copy sheets; and selecting means for selecting one of a plurality of copy modes, said plurality of copy modes including a specific copy mode for copying images of a plurality of originals on one sheet and another copy mode for copying an image of one original on one side of a sheet.

32. An apparatus as defined in claim 31, wherein said images of N sheets of originals are copied on one sheet, and said determining means determines that each set of copies includes one sheet copy when the number of originals to be copied is equal to or less than N sheets of originals.

* * * * *